US006354072B1

(12) United States Patent
Hura

(10) Patent No.: US 6,354,072 B1
(45) Date of Patent: Mar. 12, 2002

(54) METHODS AND APPARATUS FOR DECREASING COMBUSTOR EMISSIONS

(75) Inventor: Harjit S. Hura, Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/458,751

(22) Filed: Dec. 10, 1999

(51) Int. Cl.[7] ..... F02C 7/26; F02G 3/00
(52) U.S. Cl. ..... 60/39.06
(58) Field of Search ..... 60/748, 737, 39.06; 249/404, 407, 408, 423

(56) References Cited

U.S. PATENT DOCUMENTS 3,638,865 A * 2/1972 McEneny et al. ..... 60/748 X
3,853,273 A * 12/1974 Bahr et al. ..... 60/748 X
4,845,940 A * 7/1989 Beér ..... 60/748 X
5,647,538 A * 7/1997 Richardson ..... 239/423 X
5,680,754 A 10/1997 Giffin et al.
5,737,921 A * 4/1998 Jones et al. ..... 60/748 X
5,761,906 A 6/1998 Norster
6,092,363 A 7/2000 Ryan
6,240,731 B1 6/2001 Hoke et al.
6,250,061 B1 6/2001 Orlando

* cited by examiner

*Primary Examiner*—Charles G. Freay
*Assistant Examiner*—William H Rodriguez
(74) *Attorney, Agent, or Firm*—Andrew C. Hess; William Scott Andes

(57) ABSTRACT

A combustor includes a fuel injector for injecting fuel into the combustor, a baseline air blast pilot splitter including a converging downstream side and a splitter extension. The splitter extension includes a diverging upstream portion attached to a baseline air blast splitter, a diverging downstream portion, and a converging intermediate portion extending between the upstream portion and the downstream portion.

20 Claims, 2 Drawing Sheets

METHODS AND APPARATUS FOR DECREASING COMBUSTOR EMISSIONS

BACKGROUND OF THE INVENTION

This invention relates to combustors, and more particularly, to gas turbine combustors.

Air pollution concerns worldwide have led to stricter emissions standards both domestically and internationally. Aircraft are governed by both Environmental Protection Agency (EPA) and International Civil Aviation Organization (ICAO) standards. These standards regulate the emission of oxides of nitrogen (NOx), unburned hydrocarbons (HC), and carbon monoxide (CO) from aircraft in the vicinity of airports, where they contribute to urban photochemical smog problems. Most aircraft engines are able to meet current emission standards using combustor technologies and theories proven over the past 50 years of engine development. However, with the advent of greater environmental concern worldwide, there is no guarantee that future emissions standards will be within the capability of current combustor technologies. New designs and technology will be necessary to meet more stringent standards.

In general, these emissions fall into two classes: those formed because of high flame temperatures (NOx), and those formed because of low flame temperatures which do not allow the fuel-air reaction to proceed to completion (HC & CO). A small window exists where both pollutants are minimized. For this window to be effective, however, the reactants must be well mixed, so that burning will occur evenly across the mixture without hot spots, where NOx is produced, or cold spots, where CO and HC are produced. Hot spots are produced where the mixture of fuel and air is near a specific ratio where all fuel and air react (i.e. no unburned fuel or air is present in the products). This mixture is called stoichiometric. Cold spots can occur if either excess air is present in the products (called lean combustion), or if excess fuel is present in the products (called rich combustion).

Modern gas turbine combustors consist of between 10 and 30 mixers, which mix high velocity air with a fine fuel spray. These mixers usually consist of a single fuel injection source located at the center of a device designed to swirl the incoming air to enhance flame stabilization and mixing. Both the fuel injector and mixer are located on the combustor dome. In general, the fuel to air ratio in the mixer is rich. Since the overall combustor fuel-air ratio of gas turbine combustors is lean, additional air is added through discrete dilution holes prior to exiting the combustor. Poor mixing and hot spots can occur both at the dome, where the injected fuel must vaporize and mix prior to burning, and in the vicinity of the dilution holes, where air is added to the rich dome mixture. Properly designed, rich dome combustors are very stable devices with wide flammability limits and can produce low HC and CO emissions, and acceptable NOx emissions. However, a fundamental limitation on rich dome combustors exists, since the rich dome mixture must pass through stoichiometric or maximum NOx producing regions prior to exiting the combustor. This is particularly important as the operating pressure ratio (OPR) of modern gas turbines increases for improved cycle efficiencies and compactness, the combustor inlet temperatures and pressures increase the rate of NOx production dramatically. As emission standards become more stringent and OPR's increase, it appears unlikely that traditional rich dome combustors will be able to meet the challenge.

Lean dome combustors have the potential to solve some of these problems. One such current state-of-the-art design of lean dome combustor is referred to as a dual annular combustor (DAC) because it includes two radially stacked mixers on each fuel nozzle which appears as two annular rings when viewed from the front of the combustor. The additional row of mixers allows the design to be tuned for operation at different conditions. At idle, the outer mixer is fueled, which is designed to operate efficiently at idle conditions. At higher powers, both mixers are fueled with the majority of fuel and air supplied to the inner annulus, which is designed to operate most efficiently and with few emissions at higher powers. Such a design is a compromise between low NOx and CO/HC. While the mixers have been tuned to allow optimal operation with each dome, the boundary between the domes quenches the CO reaction over a large region, which makes the CO of these designs higher than similar rich dome single annular combustors (SAC's). This application, however, is quite successful, has been in service for several years, and is an excellent compromise between low power emissions and high power NOx.

Other recent designs alleviate the problems discussed above with the use of a novel lean dome combustor concept. Instead of separating the pilot and main stages in separate domes and creating a significant CO quench zone at the interface, the mixer incorporates concentric, but distinct pilot and main air streams within the device. However, the simultaneous control of low power CO/HC and smoke emission is difficult with such designs because increasing the fuel/air mixing often results in high CO/HC emissions and vice-versa. The swirling main air naturally tends to entrain the pilot flame and quench it. To prevent the fuel spray from getting entrained into the main air, the pilot establishes a narrow angle spray. This results in a long jet flames characteristic of a low swirl number flow. Such pilot flames produce high smoke, carbon monoxide, and hydrocarbon emissions and have poor stability.

BRIEF SUMMARY OF THE INVENTION

In an exemplary embodiment, a combustor operates with high combustion efficiency and low carbon monoxide, hydrocarbon, and smoke emissions. The combustor includes a fuel injector for injecting fuel into the combustor, a baseline air blast pilot splitter including a downstream side which converges towards a center body axis of symmetry, and a splitter extension. The splitter extension includes a diverging upstream portion attached to the pilot splitter, a diverging downstream portion, and an intermediate portion extending between the upstream portion and the downstream portion.

The splitter extension increases an effective pilot flow swirl number for an inner and an outer vane angle. The increased effective swirl number results in a stronger on-axis recirculation zone. Recirculating gas provides oxygen for completing combustion in the fuel-rich pilot cup, creates intense mixing and high combustion rates, and burns off soot produced in the flame. The splitter extension enables a swirl stabilized flame with lower vane angles. The splitter extension also decreases the velocity of pilot fuel being injected into the combustor and the velocity of the pilot inner airflow stream. The lower velocities improve fuel and air mixing, and increase the fuel residence time in the flame. Fuel entrainment and carryover in the pilot outer airflow stream are also decreased by the splitter extension. Lastly, the splitter extension physically delays the mixing of the pilot inner and outer airflows causing such a mixing to be less intense due to the lower velocities of the pilot airflows at the exit of the splitter extension. As a result, a combustor is provided which operates with a high combustion efficiency while maintaining low carbon monoxide, hydrocarbon, and smoke emissions.

DETAILED DESCRIPTION OF THE INVENTION

Figure 1:
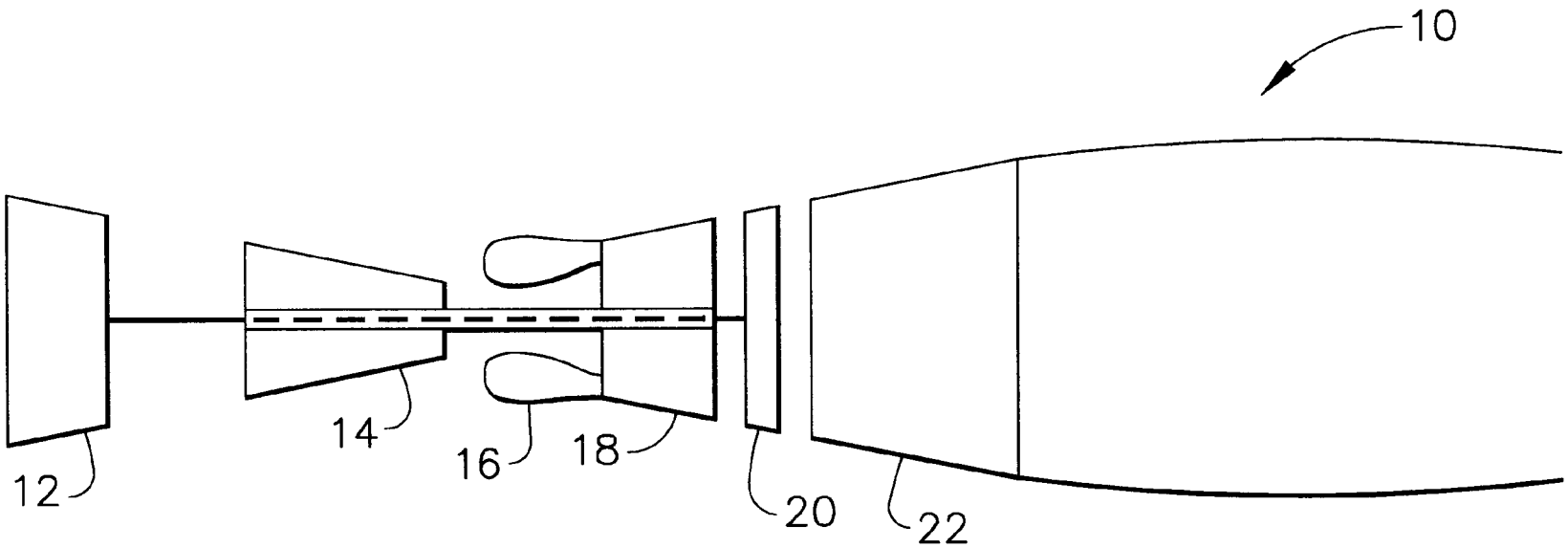
FIG. 1 is schematic illustration of a gas turbine engine including a combustor.

FIG. 1 is a schematic illustration of a gas turbine engine 10 including a low pressure compressor 12, a high pressure compressor 14, and a combustor 16. Engine 10 also includes a high pressure turbine 18, a low pressure turbine 20, and a power turbine 22.

In operation, air flows through low pressure compressor 12 and compressed air is supplied from low pressure compressor 12 to high pressure compressor 14. The highly compressed air is delivered to combustor 16. Airflow from combustor 16 drives turbines 18, 20, and 22.

Figure 2:
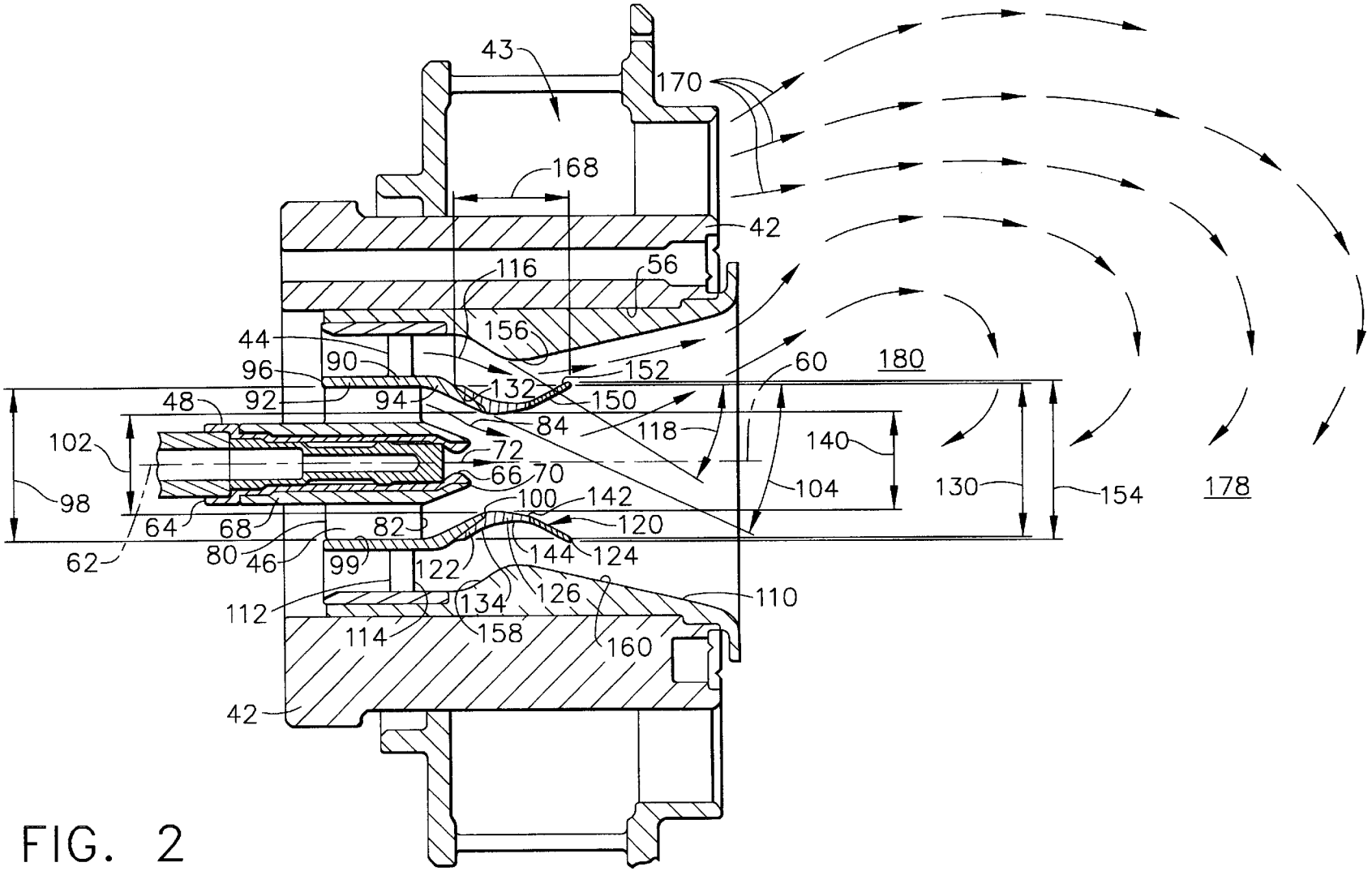
FIG. 2 is a cross-sectional view of the combustor shown in FIG. 1 including a splitter extension.

FIG. 2 is a cross-sectional view of combustor 16 (shown in FIG. 1) for a gas turbine engine (not shown). In one embodiment, the gas turbine engine is a GE90 available from General Electric Company, Evendale, Ohio. Alternatively, the gas turbine engine is a F110available from General Electric Company, Evendale, Ohio. Combustor 16 includes a center body 42, a main swirler 43, a pilot outer swirler 44, a pilot inner swirler 46, and a pilot fuel injector 48. Center body 42 has an axis of symmetry 60, and is generally cylindrical-shaped with an annular cross-sectional profile (not shown). An inner flame (not shown), sometimes referred to as a pilot, is a spray diffusion flame fueled entirely from gas turbine start conditions. At increased gas turbine engine power settings, additional fuel is injected into combustor 16 through fuel injectors (not shown) disposed within center body 42.

Pilot fuel injector 48 includes an axis of symmetry 62 and is positioned within center body 42 such that fuel injector axis of symmetry 62 is substantially coaxial with center body axis of symmetry 60. Fuel injector 48 injects fuel to the pilot and includes an intake side 64, a discharge side 66, and a body 68 extending between intake side 64 and discharge side 66. Discharge side 66 includes a convergent discharge nozzle 70 which directs a fuel-flow 72 outward from fuel injector 48 substantially parallel to center body axis of symmetry 60.

Pilot inner swirler 46 is annular and is circumferentially disposed around pilot fuel injector 48. Pilot inner swirler 46 includes an intake side 80 and an outlet side 82. An inner pilot airflow stream 84 enters pilot inner swirler intake side 80 and exits outlet side 82.

A baseline air blast pilot splitter 90 is positioned downstream from pilot inner swirler 46. Baseline air blast pilot splitter 90 includes an upstream side 92, and a downstream side 94. Upstream side 92 includes a leading edge 96 and has a diameter 98 which is constant from leading edge 96 to downstream side 94. Upstream side 92 includes an inner surface 99 positioned substantially parallel and adjacent pilot inner swirler 46.

Baseline air blast pilot splitter downstream side 94 extends from upstream side 92 to a trailing edge 100 of baseline air blast pilot splitter 90. Trailing edge 100 has a diameter 102 less than upstream side diameter 98. Downstream side 94 is convergent towards pilot fuel injector 48 at an angle 104 with respect to center body axis of symmetry 60.

Pilot outer swirler 44 extends substantially perpendicularly from baseline air blast pilot splitter 90 and attaches to a contoured wall 110. Contoured wall 110 is attached to center body 42. Pilot outer swirler 44 is annular and is circumferentially disposed around baseline air blast pilot splitter 90. Pilot outer swirler 44 has an intake side 112 and an outlet side 114. An outer pilot airflow stream 116 enters pilot outer swirler intake side 112 and is directed at an angle 118.

A splitter extension 120 is positioned downstream from baseline air blast pilot splitter 90. Splitter extension 120 includes an upstream portion 122, a downstream portion 124, and an intermediate portion 126 extending between upstream portion 122 and downstream portion 124. Upstream portion 122 has a first diameter 130, an inner surface 132, and an outer surface 134. Inner surface 132 of splitter extension upstream portion 122 is divergent and is attached to downstream side 94 of baseline air blast pilot splitter 90. Intermediate portion 126 extends from upstream portion 122 and converges towards center body axis of symmetry 60. Intermediate portion 126 includes a second diameter 140 which is less than upstream portion first diameter 130, an inner surface 142, and an outer surface 144. Downstream portion 124 extends from intermediate portion 126 and includes an inner surface 150, an outer surface 152, and a third diameter 154. Downstream portion 124 is divergent from center body axis of symmetry 60 and accordingly third diameter 154 is larger than intermediate portion second diameter 140.

Splitter extension downstream portion 124 diverges towards contoured wall 110. Contoured wall 110 includes an apex 156 positioned between a convergent section 158 of contoured wall 110 and a divergent section 160 of contoured wall 110. Splitter extension 120 includes a length 168 which extends from splitter extension upstream portion 122 to splitter extension downstream portion 124. Contoured wall 110 extends to main swirler 43. Main swirler 43 is positioned circumferentially around contoured wall 110 and directs swirling airflow 170 into a combustor cavity 178.

In operation, inner pilot airflow stream 84 enters pilot inner swirler intake side 80 and is accelerated outward from inner swirler outlet side 82. Inner pilot airflow stream 84 flows substantially parallel to center body axis of symmetry 60 and strikes baseline air blast splitter 90. Pilot splitter 90 directs inner airflow 84 in a swirling motion towards fuel-flow 72 at angle 104. Inner airflow 84 impinges on fuel-flow 72 to mix and atomize fuel-flow 72 without collapsing a spray pattern (not shown) exiting pilot fuel injector 48.

Simultaneously, outer pilot airflow stream 116 is accelerated through pilot outer swirler 44. Outer airflow 116 exits outer swirler 44 flowing substantially parallel to center body axis of symmetry 60. Outer airflow 116 continues substantially parallel to center body axis of symmetry 60 and strikes contoured wall 110. Contoured wall 110 directs outer airflow 116 at angle 118 towards center body axis of symmetry in a swirling motion. Outer airflow 116 continues flowing towards center body axis of symmetry 60 and strikes splitter extension upstream outer surface 134.

Splitter extension upstream outer surface 134 directs airflow 116 towards splitter extension intermediate outer surface 144 where airflow 116 is redirected towards contoured wall divergent section 160. Outer airflow 116 flows over splitter extension length 168 and continues flowing substantially parallel to contoured wall 110 until impacted upon by airflow 170 exiting main swirler 43.

Inner pilot airflow stream 84 impinges on fuel-flow 72 to create a fuel and air mixture which flows through splitter extension 120. Splitter extension 120 decelerates the velocity of the mixture and thus increases the amount of residence time for the mixture within center body 42. The increased residence time permits greater evaporation and improves the mixing of fuel-flow 72 and inner pilot airflow stream 84. The lower velocity also permits the mixture to spend more time inside a pilot flame (not shown) to provide a more thorough burning of the mixture. Splitter extension 120 increases a pilot swirl number and brings the flame inside center body 42, thus, substantially improving flame stability and decreasing carbon monoxide, hydrocarbon, and smoke emissions.

Splitter extension length 168 permits splitter extension 120 to isolate outer pilot airflow stream 116 from inner pilot airflow stream 84 and delays any mixing between streams 84 and 116. Splitter extension length 168 also permits individual control of inner pilot airflow stream 84 and outer pilot airflow stream 116 which results in less fuel entrainment or carryover by outer pilot airflow stream 116. Individually controlling inner pilot airflow stream 84 and outer pilot airflow stream 116 permits the velocity of outer pilot airflow stream 116 to be decreased. Lowering the axial velocity of outer pilot airflow stream 116 creates a lower velocity differential between inner pilot airflow stream 84 and outer pilot airflow stream 116. The lower velocity increases the residence time and decreases the fuel entrainment and quenching by outer pilot airflow stream 116. As a result, combustor 16 operates with a high efficiency and with low carbon monoxide and hydrocarbon emissions.

The increase in the pilot swirl number caused by splitter extension 120 results in a strong axial recirculation zone 180 which, in combination with the decreased velocity of the pilot fuel/air mixture, creates a strong suck back (not shown) within center body 42 which causes any unburned combustion products (not shown) to be recirculated in the pilot flame. As a result of the suck back, or the reversed airflow, combustion efficiency is substantially improved. In addition, the recirculating combustion gas brings oxygen from main air stream 170 into the pilot flame. As a result, soot (not shown) produced in the pilot flame is burned off rather than emitted.

The above-described combustor is cost-effective and highly reliable. The combustor includes a splitter extension including an upstream portion, a downstream portion, and an intermediate portion extending between the upstream portion and the downstream portion. The upstream portion is divergent and extends to a convergent intermediate portion. The convergent intermediate portion extends to a divergent downstream portion. As a result of the splitter extension, a combustor is provided which operates with little fuel entrainment and an increased residence time for a fuel/air mixture within a center body portion of the combustor. Thus, a combustor is provided which operates at a high combustion efficiency and with low carbon monoxide, hydrocarbon, and low smoke emissions.

While the invention has been described in terms of various specific embodiments, those skilled in the art will recognize that the invention can be practiced with modification within the spirit and scope of the claims.

What is claimed is:

1. A method for reducing an amount of carbon monoxide and hydrocarbon emissions and smoke from a gas turbine combustor using a splitter extension, the combustor including a pilot fuel injector, a baseline air blast pilot splitter including a convergent portion, and a center body, the convergent portion extending downstream to an end, the splitter extension including a divergent upstream portion, a divergent downstream portion, and a convergent intermediate portion extending between the upstream portion and the downstream portion, the upstream portion having a first diameter and attached to the baseline air blast pilot splitter, the downstream portion having a second diameter, said method comprising the steps of:

injecting fuel into the combustor; and directing airflow into the combustor such that the airflow passes through the baseline air blast splitter into the splitter extension attached to the end of the baseline air blast splitter convergent portion.

2. A method in accordance with claim 1 further comprising the step of directing airflow into the combustor such that the airflow passes around the baseline air blast splitter and around the splitter extension divergent upstream portion, the convergent intermediate portion, and the divergent downstream portion.

3. A method in accordance with claim 2 wherein the baseline air blast pilot splitter includes an upstream side and an downstream side having a diameter less than the splitter extension upstream portion, the splitter extension intermediate portion having a third diameter less than the blast pilot splitter downstream side diameter, said step of directing the airflow into the combustor through the air blast splitter further comprising using the splitter extension to decrease the velocity of the fuel being injected after the fuel has been injected into the combustor.

4. A method in accordance with claim 3 wherein the combustor further includes an axial airflow and an outer airflow within the center body portion of the combustor, said method further comprising the steps of:

using the splitter extension to decrease the velocity of the inner airflow after the inner airflow has been axially directed into the combustor; and using the splitter extension to increase an effective pilot flow swirl number at low pilot vane angles.

5. A method in accordance with claim 4 further comprising the step of using the splitter extension to decrease the velocity of the outer airflow after the outer airflow has been directed into the combustor.

6. A method in accordance with claim 5 wherein said step of using the splitter extension to decrease the velocity of the outer airflow further comprises the step of decreasing the fuel entrainment within the combustor.

7. An extension for a gas turbine combustor, the combustor including a fuel injector and a baseline air blast pilot splitter including a convergent portion, said extension comprising an upstream portion, a downstream portion, and an intermediate portion extending between said upstream portion and said downstream portion, said upstream portion attached to a downstream end of the baseline air blast pilot splitter.

8. An extension in accordance with claim 7 wherein said intermediate portion comprises a third diameter.

9. An extension in accordance with claim 8 wherein said intermediate portion third diameter is less than said upstream portion first diameter.

10. An extension in accordance with claim 9 wherein said intermediate portion third diameter is less than said downstream portion second diameter.

11. An extension in accordance with claim 10 wherein the baseline air blast pilot splitter includes an upstream side and a downstream side, the downstream side having a diameter, said extension upstream portion first diameter greater than said blast pilot splitter downstream side diameter.

12. An extension in accordance with claim 11 wherein said intermediate portion second diameter is less than said baseline air blast pilot splitter downstream side diameter.

13. A combustor for a gas turbine comprising:

a fuel injector;

a center body comprising an annular body and having an axis of symmetry, said fuel injector disposed within said center body;

a baseline air blast pilot splitter comprising an upstream side and an downstream side, said downstream side converging towards said center body axis of symmetry; and a splitter extension comprising a diverging upstream portion, a diverging downstream portion, and an intermediate portion extending between said upstream portion and said downstream portion, said upstream portion attached to an end of said baseline air blast pilot splitter.

14. A combustor in accordance with claim 13 wherein said splitter extension intermediate portion converges towards said center body axis of symmetry.

15. A combustor in accordance with claim 14 wherein said splitter extension upstream portion comprises a first diameter, said splitter extension intermediate portion comprises a second diameter, said splitter extension downstream portion comprises a third diameter, said second diameter less than said first diameter.

16. A combustor in accordance with claim 15 wherein said splitter extension intermediate portion second diameter is less than said downstream portion third diameter.

17. A combustor in accordance with claim 15 wherein said splitter extension comprises a length extending from a first end adjacent said upstream portion to a second end adjacent said downstream portion, said length configured to permit said splitter extension to decelerate a fuel spray injected axially by said fuel injector.

18. A combustor in accordance with claim 17 further comprising an outer swirler configured to introduce an airflow to said combustor externally to said baseline air blast pilot splitter, said splitter extension length configured to separate said external airflow from said axially injected fuel spray flow.

19. A combustor in accordance with claim 16 wherein said splitter extension is configured to decrease carbon monoxide emissions from said combustor.

20. A combustor in accordance with claim 16 wherein said splitter extension is configured to decrease hydrocarbon emissions and smoke emissions from said combustor.

* * * * *

UNITED STATES PATENT AND TRADEMARK OFFICE

CERTIFICATE OF CORRECTION

PATENT NO. : 6,354 072 B1
DATED : March 12, 2002
INVENTOR(S) : Hura

It is certified that error appears in the above-identified patent and that said Letters Patent is hereby corrected as shown below:

Column 7,
Line 7, delete "an downstream" and insert therefore -- a downstream --.

Signed and Sealed this

Twenty-third Day of September, 2003

JAMES E. ROGAN
*Director of the United States Patent and Trademark Office*